US012036446B2

(12) United States Patent
Woodman et al.

(10) Patent No.: US 12,036,446 B2
(45) Date of Patent: Jul. 16, 2024

(54) TRAMPOLINE

(71) Applicants: PLUM PRODUCTS HOLDINGS PTY. LTD., Neutral Bay (AU); David Woodman, Ingham (GB); Wai Ki Leung, Kowloon (HK); Joseph Mazoyer, Lyons (FR); Philippe Bajard, Lyons (FR)

(72) Inventors: David Woodman, Ingham (GB); Wai Ki Leung, Kowloon (HK); Joseph Mazoyer, Lyons (FR); Philippe Bajard, Lyons (FR)

(73) Assignee: PLUM PRODUCTS HOLDINGS PTY. LTD., New South Wales (AU)

( * ) Notice: Subject to any disclaimer, the term of this patent is extended or adjusted under 35 U.S.C. 154(b) by 476 days.

(21) Appl. No.: 17/297,308

(22) PCT Filed: Nov. 26, 2019

(86) PCT No.: PCT/GB2019/000164
§ 371 (c)(1),
(2) Date: May 26, 2021

(87) PCT Pub. No.: WO2020/109747
PCT Pub. Date: Jun. 4, 2020

(65) Prior Publication Data

US 2021/0402239 A1 Dec. 30, 2021

(30) Foreign Application Priority Data

Nov. 26, 2018 (GB) ..... 1819216
Nov. 18, 2019 (GB) ..... 1916787

(51) Int. Cl.
*A63B 5/11* (2006.01)
*A63B 21/02* (2006.01)
(Continued)

(52) U.S. Cl.
CPC ..... *A63B 5/11* (2013.01); *A63B 21/023* (2013.01); *A63B 71/0054* (2013.01); *A63B 71/022* (2013.01)

(58) Field of Classification Search
CPC ..... A63B 5/11; A63B 21/023; A63B 71/0054; A63B 71/022; A63B 21/025; A63B 21/026; A63B 21/0552; A63B 21/02
See application file for complete search history.

(56) References Cited

U.S. PATENT DOCUMENTS 4,336,933 A * 6/1982 Appelbaum ..... A63B 69/0035 482/29
5,810,695 A * 9/1998 Sass ..... B63B 34/52 441/37

(Continued)

FOREIGN PATENT DOCUMENTS

CN 1273536 A 11/2000
CN 207679923 U 8/2018

(Continued)

*Primary Examiner* — Garrett K Atkinson
(74) *Attorney, Agent, or Firm* — Rabin & Berdo, P.C.

(57) ABSTRACT

A trampoline having a frame and a jumping mat formed in a single piece from woven elasticated material. The trampoline has a flat base portion lower than the periphery of the jumping mat, and an integral side portion continuous with the base portion around the entire periphery thereof and extending to the periphery of the jumping mat. The jumping mat is connected to the frame by at least two biasing connectors to be supported under tension above ground or floor. The frame may include a first circumextending support coupled to the periphery of the jumping mat by at least one biasing connector to support the periphery of the jumping mat above the ground or floor. A circumextending safety enclosure net has first and second portions extending respectively above and below the level of the first circumextending (Continued)

support. the second portion extending to a second circum-extending support forming part of the frame.

17 Claims, 8 Drawing Sheets

(51) Int. Cl.
*A63B 71/00* (2006.01)
*A63B 71/02* (2006.01)

(56) References Cited

U.S. PATENT DOCUMENTS 5,941,798 A * 8/1999 Coan ..... A63B 5/11 482/28
6,132,338 A * 10/2000 Shifferaw ..... A63B 5/08 482/52
6,319,174 B1 * 11/2001 Alexander ..... A63B 5/11 482/28
6,663,538 B2 * 12/2003 Yoon ..... A63B 5/11 482/28
7,481,740 B2 * 1/2009 Colling ..... A63B 71/0054 482/28
7,611,443 B2 * 11/2009 Publicover ..... A63B 71/023 482/28
7,641,594 B2 * 1/2010 Hickey ..... A63B 5/11 239/289
7,678,024 B2 * 3/2010 Alexander ..... A63B 5/11 482/28
7,708,667 B2 * 5/2010 Alexander ..... A63B 5/11 482/28
7,854,687 B2 * 12/2010 Alexander ..... A63B 5/11 482/28
8,303,469 B2 * 11/2012 Alexander ..... A63B 5/11 482/27
D684,233 S * 6/2013 Yang ..... D21/797
9,295,867 B1 * 3/2016 DeVore ..... A63B 5/11
9,706,854 B1 * 7/2017 Zhou ..... A63B 71/022
10,124,199 B2 * 11/2018 Andon ..... A63B 5/11
10,434,350 B2 * 10/2019 Chen ..... A63B 71/04
2002/0098948 A1 * 7/2002 Yoon ..... A63B 5/11 482/27
2005/0043122 A1 * 2/2005 Publicover ..... A63B 71/06 473/465
2006/0194674 A1 * 8/2006 Hickey ..... A63B 5/11 482/29
2006/0270525 A1 * 11/2006 Colling ..... A63B 5/11 482/29
2007/0004560 A1 * 1/2007 Nelson ..... A63B 5/11 482/29
2007/0010374 A1 * 1/2007 Widich ..... A63B 5/11 482/27
2007/0012902 A1 * 1/2007 Mo ..... A63B 71/0054 256/24
2013/0210590 A1 * 8/2013 Publicover ..... A63B 5/11 482/110
2014/0051550 A1 * 2/2014 Chen ..... A63B 5/11 482/1
2014/0066259 A1 * 3/2014 Andon ..... A63B 5/11 482/27
2014/0371031 A1 * 12/2014 Allen ..... A63B 5/11 482/27
2015/0045188 A1 * 2/2015 Allen ..... A63B 71/022 482/27
2018/0290000 A1 * 10/2018 Chen ..... A63B 71/022

FOREIGN PATENT DOCUMENTS

DE 2052258 A1 4/1972
DE 102008003727 A1 7/2009
DE 202014102711 U1 6/2014
GB 2454029 A 4/2009
WO 2015157828 A1 10/2015

* cited by examiner (SEGMENT A-A)

TRAMPOLINE

BACKGROUND

This disclosure relates to trampolines.

In practice there are two entirely separate markets for trampolines, namely trampolines designed for athletic competition, and trampolines for family use as play equipment.

Trampolines for use as play equipment traditionally comprise a flat jumping mat connected to a frame, the flat mat being held under tension by a plurality of springs, historically helical springs, or, more recently, by alternative means for holding the mat flat and under tension such as leaf springs, and are usually supplied together with a safety net enclosure to prevent a user being accidentally injured as the result of being propelled from or falling off the trampoline.

In GB 2454029 Plum Products Ltd, a trampoline is described with an improved safety enclosure net. As shown in FIG. 1 of the accompanying drawings, which corresponds to FIG. 6 of GB 2454029, a circumextending net 1 was supported by a plurality of poles 2 coupled to or forming part of support structure 3 of the trampoline, so that for most of the height of the net, its position corresponded to the periphery of the support structure, while a lower portion 4 of the net was displaced inwardly so that it could be coupled to the periphery of trampoline mat 5 inboard of springs 6. This arrangement largely prevented a user from inadvertently stepping on the springs 6 or on an annular mat 7, if present, placed over the springs 6. The net 1 was suitably mounted to the poles 2 by a sleeve 8; and in some embodiments, a substantially triangular piece 9 was coupled between the lowermost portion of the sleeve and the lower portion 4 of the net. As a result, the lower portion 4 of the net sloped inwardly in a roughly frustoconical configuration.

Although the structure described in GB 2454029 has significantly improved safety for users without users feeling cramped and threatened by the enclosing net, which may occur when the whole of the net is positioned inboard of the springs, we have found that some users abused the safety net by bouncing against the sloped surface of the lower portion of the net, with a resultant risk of damage to the net.

The present disclosure arises from the Applicant's continuing endeavours to provide trampolines with enhanced user experience and with increased safety.

Flat trampoline mats are the norm as they are adapted to straight up and down jumping to achieve height.

However, other arrangements have been described in the literature. In particular, US 2015/0045188 Allen et al, as is apparent from its Abstract and from the Summary of Invention section at [0006], is primarily concerned with a trampoline with a jumping mat that has a horizontal portion between two arcuate portions at opposite ends of the horizontal portion. As shown in FIGS. 7 to 12C, both the frame and the jumping mat take on a bed-like configuration. However, Allen et al. also describe a generally dished construction with a jumping mat that has a central circular portion and a surrounding frustoconical portion. As described, and as illustrated, for example in FIG. 3*a*, in this case, the jumping mat is constructed in several individual pieces which are joined together.

SUMMARY OF THE DISCLOSURE

In accordance with a first aspect of the present disclosure there is provided a trampoline comprising: a frame and a jumping mat, the jumping mat being formed in a single piece from woven elasticated material, and comprising a generally flat base portion at a position lower than the periphery of the jumping mat, and an integral side portion continuous with the base portion around the entire periphery of the base portion and extending to the periphery of the jumping mat, the jumping mat being connected to the frame by at least two biasing connectors so that the jumping mat is supported under tension at a position above ground or flooring.

In a practical embodiment the jumping mat has a generally dished configuration with the side portion adopting a generally frustoconical configuration.

Preferred arrangements may have one or more of the following features: a first biasing connector or first set of biasing connectors connect the periphery of the jumping mat to the frame. A second biasing connector or second set of biasing connectors connect the frame to the jumping mat where the edge of the base portion is continuous with the side portion. The jumping mat may be provided with additional reinforcement where the second biasing connector or set of biasing connectors are coupled to the jumping mat. The second biasing connector or the second set of biasing connectors, together with the first biasing connector or the first set of biasing connectors hold the one-piece jumping mat under uniform tension. The first and second connectors may each or both comprise a continuous length of elastic webbing, bungee cord, or similar flexible members extending between the jumping mat and the frame. The first and/or second sets of biasing connectors may comprise one or more of: helical springs (for example made from steel or elastic), elastic webbing, individual elastic portions, individual elastic bungee cords, leaf springs, flexible rods or any combination of these. In Applicant's most preferred arrangement, a first set of biasing connectors in the form of a plurality of individual bungee cords is employed, together with a second set of biasing connectors also in the form of individual bungee cords.

Preferably, the jumping mat is formed as a single flat disc of woven elasticated material which adopts the said configuration of a base portion and an integral side portion as a result of the tension created in the material of the jumping mat by the at least two biasing connectors.

The frame preferably comprises a first circumextending support, to which the first biasing connector or first set of biasing connectors is connected, and a second circumextending support, lower than the first to which the second biasing connector or second set of biasing connectors is connected.

The side portion of the jumping mat may itself comprise two or more sections all forming, together with the flat base portion an integral one-piece jumping mat. In addition to a first side portion extending completely about and being continuous with the base portion, there may be a second side portion extending completely about and being continuous with the first side portion. In this case, it will be the second side portion that extends to the periphery of the jumping mat. A third biasing connector or set of biasing connectors is coupled between the frame and the jumping mat where the first and second side portions are continuous with each other. The first and second side portions may have frustoconical configurations with the second side portion making a smaller conical angle. In a specific embodiment, the second side portion may extend generally vertically.

The term "circumextending" does not require that the second circumextending supports lie outside the footprint of the jumping mat, although it should lie outside the footprint of the base portion.

The trampoline may also comprise a net extending above the first circumextending support to reduce the risk of users falling from the trampoline.

By "above", the Applicant is not requiring that the net extends vertically, or that the footprint of the net needs to match the first circumextending support. The net can have vertical walls, or alternatively the net can be curved, onion shaped as a whole, or frustoconical, provided that it extends generally upwards from the first circumextending support.

The trampoline may further comprise a net extending below the first circumextending support to the second circumextending support to reduce access to the first biasing connector or first set of biasing connectors, and/or the second biasing connector or second set of biasing connectors. This net may be a continuation of the same net as extends above the first circumextending support to reduce the risk of users falling off the trampoline. Alternatively or additionally, the trampoline could further comprise a net or other enclosure extending below the second circumextending support down to ground level in order to prevent users or other persons, accessing the area under the trampoline.

"Supported at a position above ground or flooring by a frame" means held so that there is space beneath the mat into which the mat can deform when the mat is jumped upon by a user. In the case of so called "in ground" trampolines, for example, the trampoline is installed into a pit dug into the ground, and the jumping mat is then held at a position above the bottom of the pit in order to provide the necessary space between the ground and the mat.

BRIEF DESCRIPTION OF THE DRAWINGS

Particular embodiments are described hereinbelow by way of example only with reference to the accompanying drawings in which.

DESCRIPTION OF PREFERRED EMBODIMENTS

Figure 1:
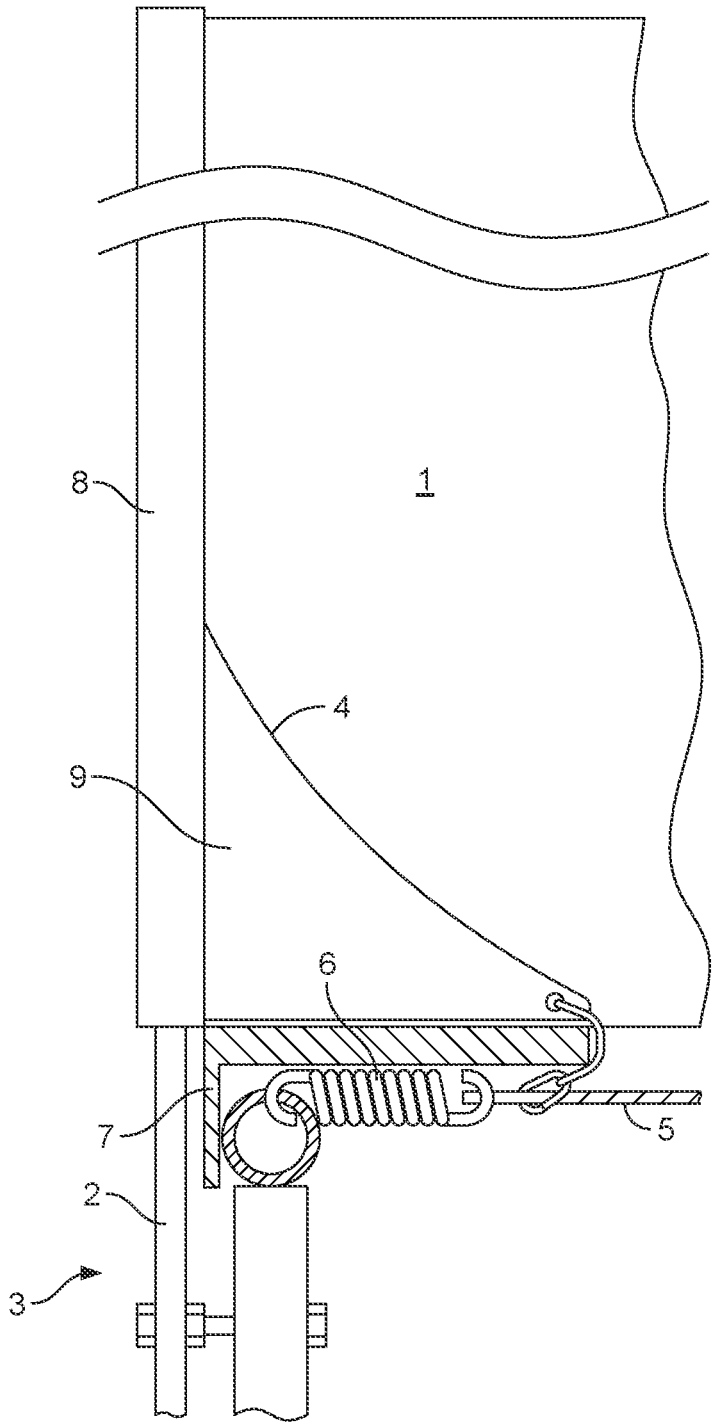
FIG. 1 PRIOR ART
FIG. 1 is a partial sectional view of a prior art trampoline taken from the aforesaid GB 2454029.
Figure 2:
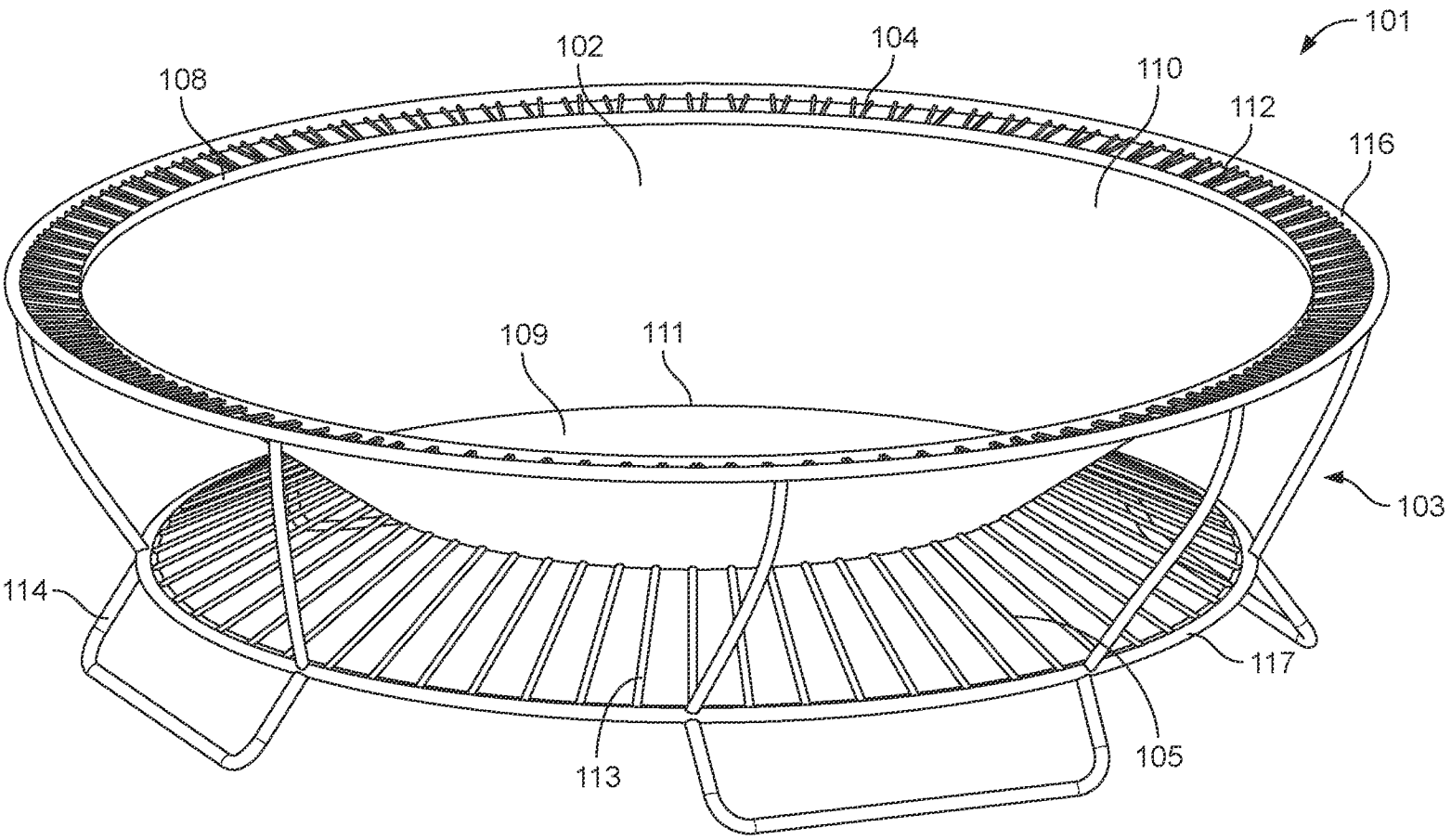
FIG. 2 is a perspective view of an embodiment of trampoline incorporating the teachings of the present disclosure with parts omitted for clarity.
Figure 4:
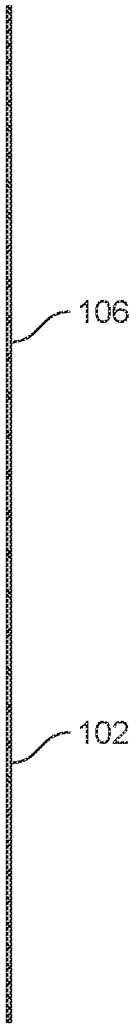
FIG. 4 is an edge view of the mat of FIG. 2.
Figure 3:
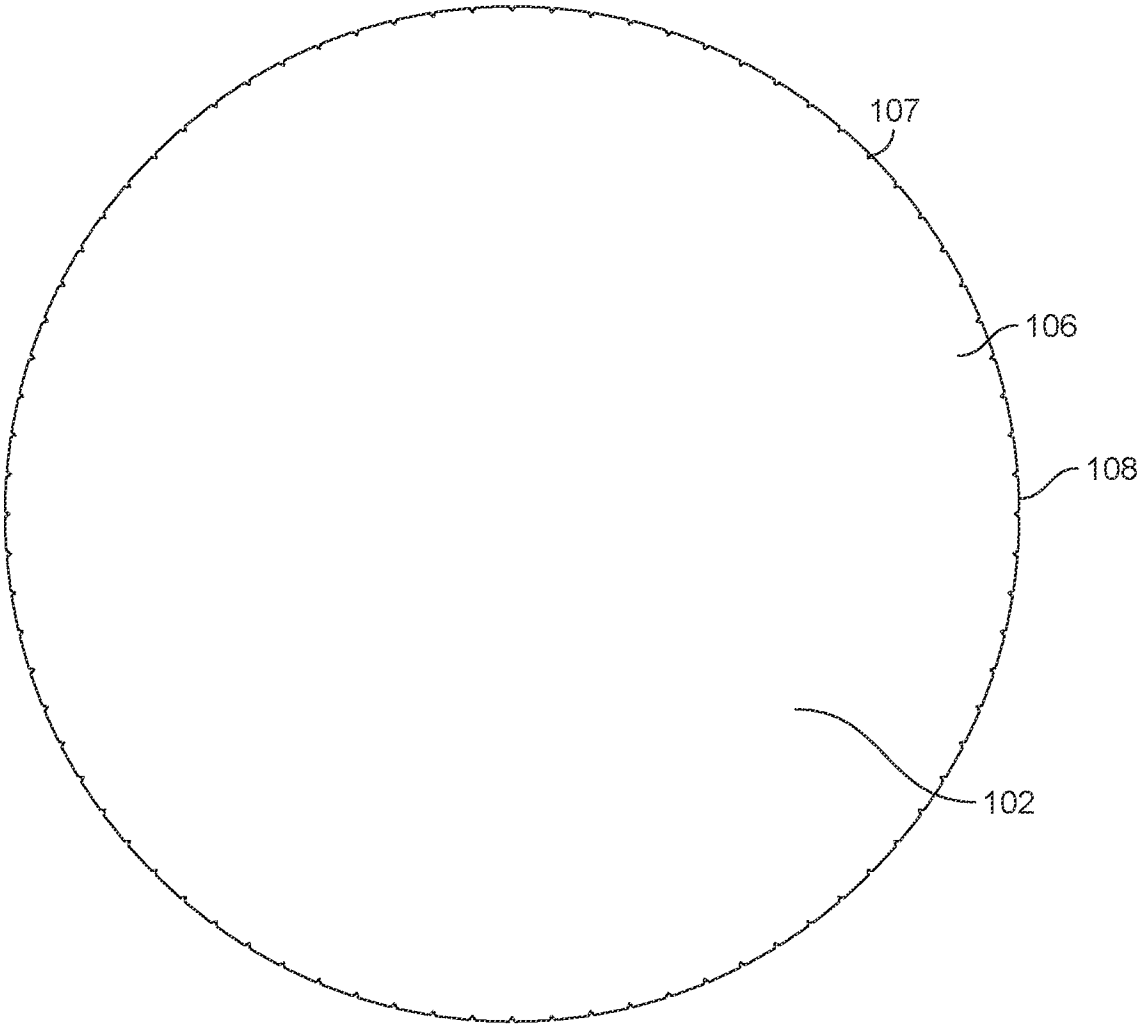
FIG. 3 is a plan view of a flat one-piece jumping mat.

Referring first to FIG. 2, there is shown a trampoline 101 comprising a jumping mat 102 with a generally dished configuration, which is connected to a frame 103 by first and second sets of biasing connectors 104, 105 at a position above the ground or flooring. Jumping mat 102 is formed as a single flat disc 106 (FIGS. 3 and 4) of woven elasticated material with a series of cut-outs 107 in its peripheral edge 108 for locating individual biasing connectors 104, which jumping mat adopts the illustrated dished configuration as a result of the tension created in the material of the jumping mat by the first and second sets of biasing connectors. The mat 102 comprises a generally flat base portion 109 at a position lower than the periphery 108 of the jumping mat, and an integral side portion 110 continuous with the base portion 109 around the entire periphery 111 of the base portion 109 and extending to the periphery 108 of the jumping mat.

The first set of biasing connectors 104 here comprise a plurality of individual elastic bungee cords 112 in this particular embodiment, but alternatives such as individual leaf springs, individual helical springs, individual elastic portions, or individual flexible rods connecting the jumping mat to the frame, or alternatively a single connector such as elastic fabric/webbing or elastic bungee cord, woven between the jumping mat and the frame, could be substituted without any major modifications to the arrangement being necessary. Alternatively, there may be a single connector such as elastic fabric/webbing or elastic bungee cord, woven between the jumping mat and the frame, in place of a set of individual connectors.

The second set of biasing connectors 105 here also comprise a plurality of individual elastic bungee cords 113 in this particular embodiment, but, again, alternatives such as individual leaf springs, individual helical springs, individual elastic portions, or individual flexible rods connecting the jumping mat to the frame, or alternatively a single connector such as elastic fabric/webbing or elastic bungee cord, woven between the jumping mat and the frame, could be substituted without any major modifications to the arrangement being necessary. Again, there may be a single connector such as elastic fabric/webbing or elastic bungee cord, woven between the jumping mat and the frame, in place of a set of individual connectors.

By manufacturing the mat 102 by die cutting it from a length of woven elasticated material, the mat has a predictable and uniform response spread throughout the warp and weft of the whole material when a user jumps on it. Although the mat 102 is suitably provided with additional reinforcement (See FIGS. 9 and 10 below) to allow it to be coupled to the first and second sets of biasing connectors 104, 105, we have found that, even with this reinforcement the reactive force of the mat is still enabled to be spread throughout the material in a way that is not possible when the mat is formed from individual pieces of material joined together by seams, since, with a cut and seamed structure, the warp and weft no longer run in a continuous fashion through the material of the mat as a whole, and the seams create an inertia to the reactive forces of the trampoline material that propel a user into a bounce with height.

Figure 5:
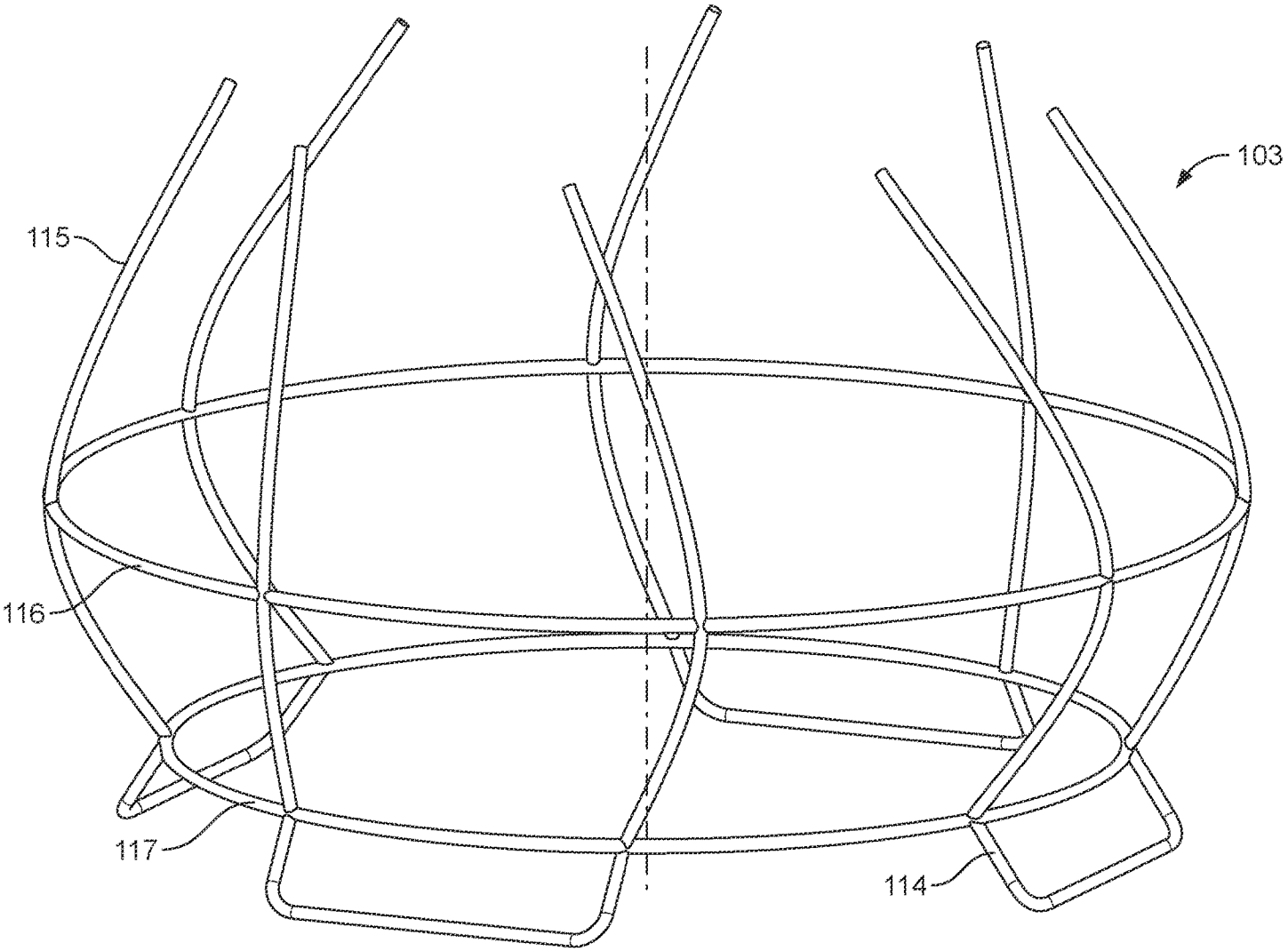
FIG. 5 is a perspective view of the frame of the trampoline of FIG. 2.

Turning now to FIG. 5, which shows a preferred frame 103 for the trampoline, with the jumping mat and biasing connectors omitted, it will be seen that frame 103 is supported above the ground or floor by a plurality of legs 114, which in this embodiment are generally U-shaped legs 114. Those involved with the design of trampolines will be familiar with alternative W-shaped, single vertical leg, T-shaped and inverted T-shaped legs, all of which could be used in place of the illustrated U-shaped legs. A plurality of curved poles 115 extend upwardly from legs 114 and are coupled to first and second circumextending support rings 116 and 117. Bungee cords 112 of the first set 104 of biasing connectors are coupled to the peripheral edge 108 of the jumping mat 2, as described below with reference to FIGS. 8 and 9, and to first circumextending support 116; while bungee cords 113 of the second set 105 of biasing connectors couple second circumextending support 117 to the jumping mat 102 in the region where the base portion 109 is continuous with the side portion 110 of the mat.

In this embodiment, the first set of biasing connectors 104 pull the periphery 108 of jumping mat 102 generally upwards and away from the centre of base portion 109. The second set of biasing connectors pull the mat 102, in the region where the base portion 109 is continuous with the side portion 110, generally downwards and away from the centre of base portion 109. As a result the jumping mat is 102 placed under a generally uniform tension throughout.

The term "circumextending" does not require that the first and second supports 116, 117 necessarily lie outside the footprint of the jumping mat as a whole.

Alternative biasing or spring arrangements could be used to support jumping mat 102 in Applicant's preferred configuration under tension. For example, the first and/or the second set of biasing connectors may comprise a plurality of flexed rods similar to those described in U.S. Pat. No. 6,319,174. If the first set of biasing connectors comprises a plurality of flexed rods similar to those described in U.S. Pat. No. 6,319,174 the first circumextending support may lie within the footprint of the jumping mat 102, and generally beneath its peripheral edge 108. If the second set of biasing connectors comprises a plurality of flexed rods similar to those described in U.S. Pat. No. 6,319,174, the second circumextending support may lie within the footprint of the base portion 109 of the jumping mat. The first and/or the second set of biasing connectors may alternatively comprise a plurality of leaf springs similar to those described in WO 2017/088023. If the first set of biasing connectors comprises a plurality of leaf springs the first circumextending support may match or lie within the footprint of the jumping mat 102 and generally beneath its peripheral edge 108. If the second set of biasing connectors comprises a plurality of leaf springs the second circumextending support may match or lie within the footprint of base portion 109 of the jumping mat and generally beneath its periphery 111.

Figure 6:
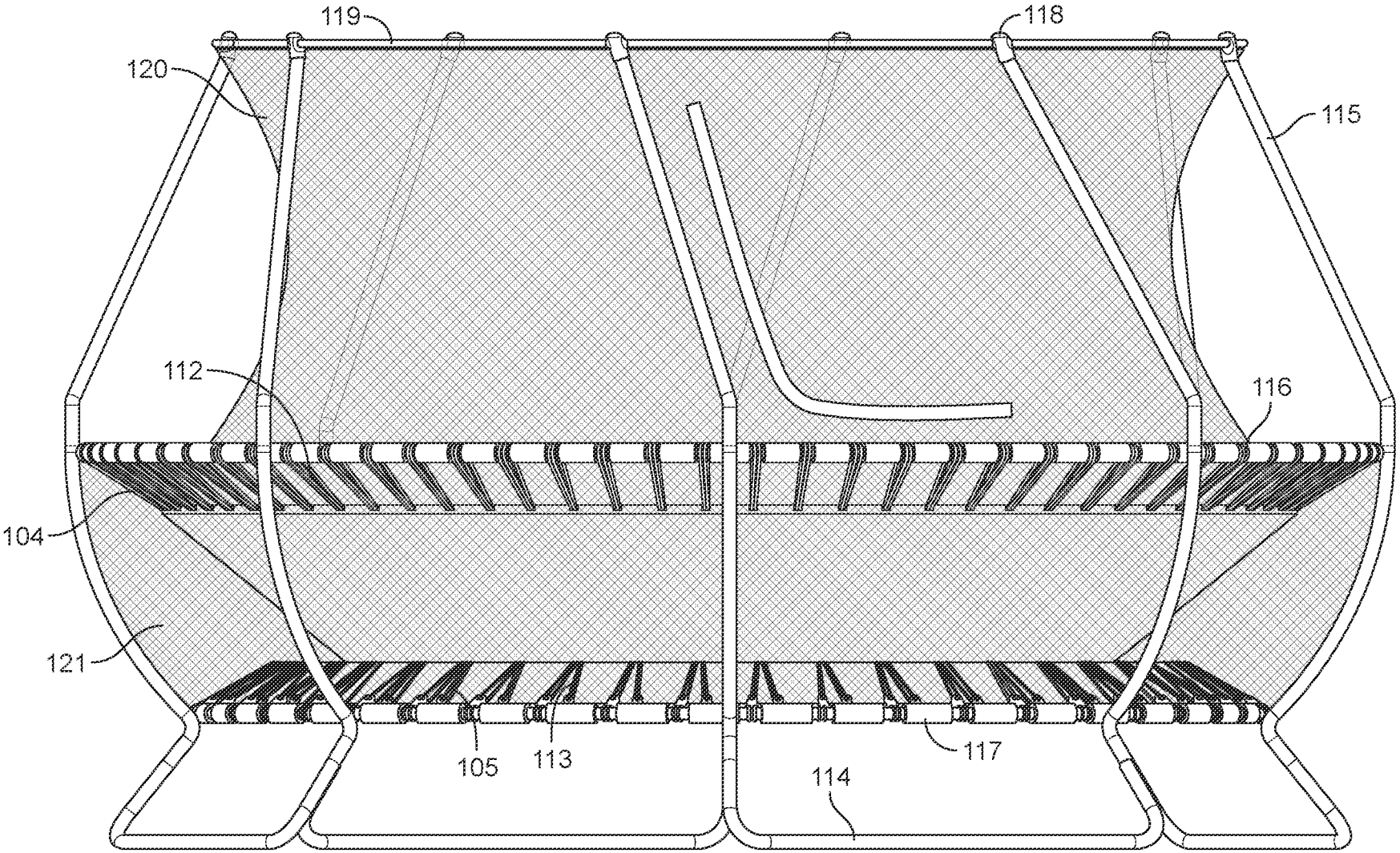
FIG. 6 is a side elevational view of the trampoline of FIG. 2.

Referring to the side elevational view of FIG. 6, it will be seen that the upper distal ends 118 of poles 115 are joined by a ring 119 from which a net 120 is supported. Net 120 is connected to the peripheral edge 108 of the jumping mat 102, outboard of the jumping space, but inboard of the first set of biasing connectors 104, preventing users from jumping on the biasing connectors 104, which may also be covered by an annular protective pad. The net will necessarily be provided with a doorway to allow access for users on to the trampoline. Since the peripheral edge 108 of the jumping mat is higher than for conventional trampolines, a ladder may need to be attached to frame 103 to allow users to climb to the level of circumextending support 116.

A second net 121, supported by poles 115, extends below first circumextending support 116 to second circumextending support 117 to restrict access to the second set of biasing connectors 105 to prevent children or adults who are not on the trampoline from getting fingers, clothing, etc. caught in the connectors. Net 121 is integrally formed with net 120. The connectors may also be covered by an annular protective cover.

Providing a trampoline with an enclosure net in which the net, in addition to having a portion extending above the level of a circumextending support coupled to the periphery of the jumping mat, and thus preventing a user from accidentally falling from the trampoline mat, has a portion extending below that circumextending support to a lower circumextending support to restrict access for non-users into space beneath the first circumextending support is believed novel in its own right.

Figure 8:
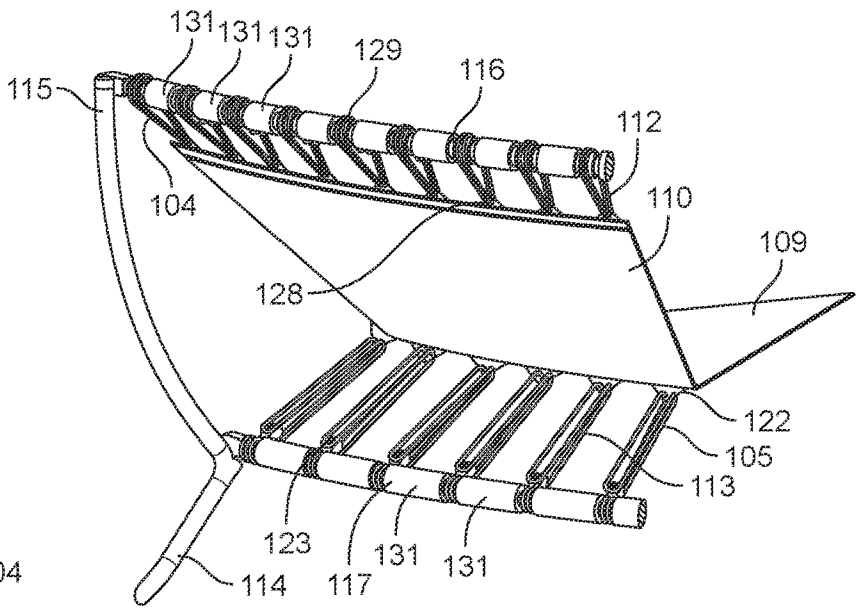
FIG. 8 is a perspective view of the segment A-A indicated in FIG. 7.
Figure 7:
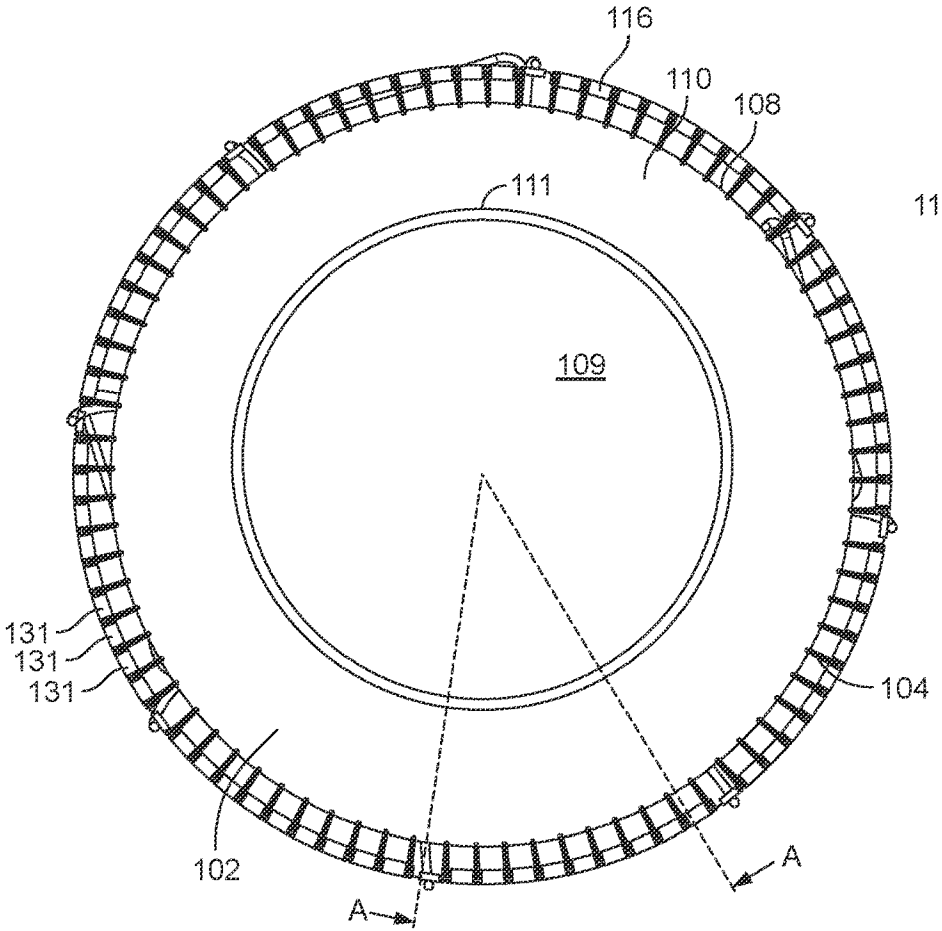
FIG. 7 is a plan view of the trampoline of FIG. 6.
Figure 9:
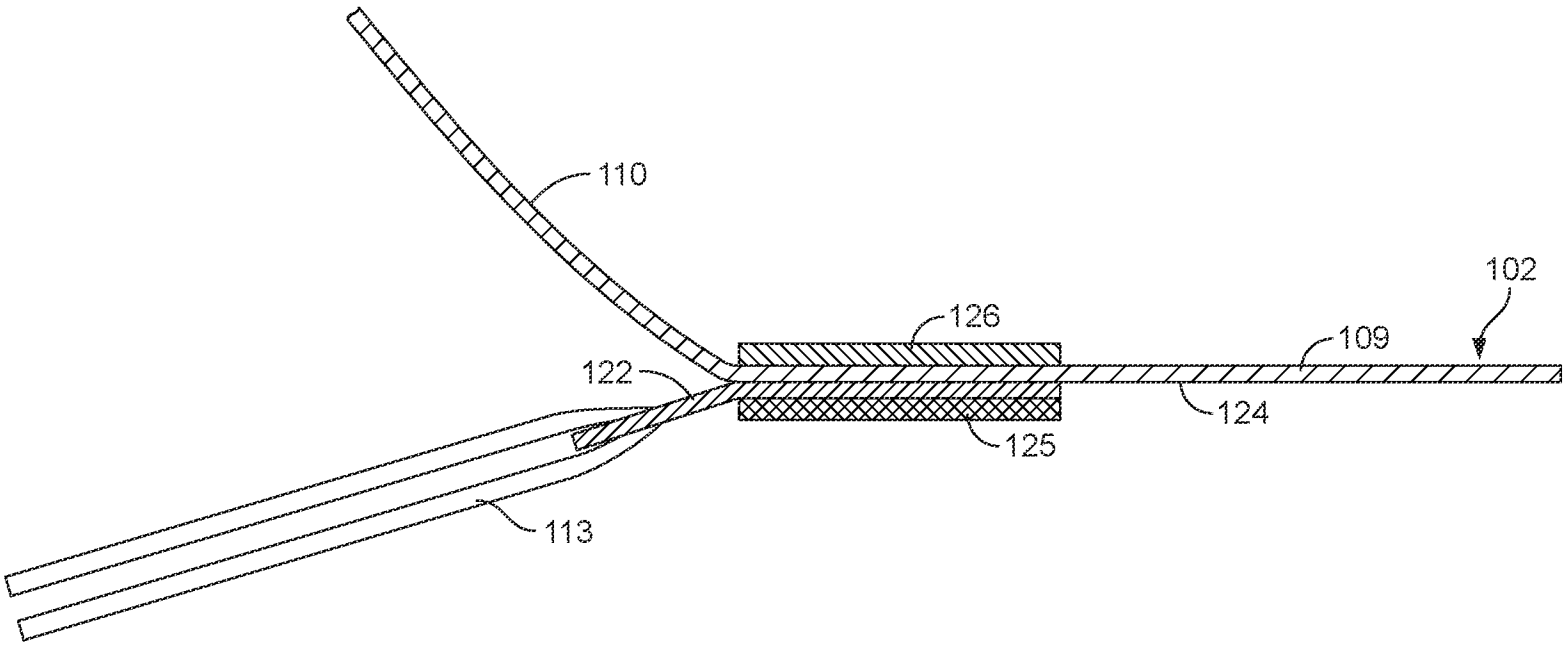
FIG. 9 is an enlarged sectional view through the portion of the mat of the trampoline of FIGS. 6-8 in the region where the side portion of the mat is continuous with the base portion of the mat.

Reference may now be made to FIGS. 7, 8 and 9 to better understand how the biasing connectors are coupled to the jumping mat and to the circumextending supports. The perspective view shown in FIG. 8 is of the segment A-A identified in the top plan view of FIG. 7, from which the portions of poles 115 extending above the level of the first circumextending support 116 and the associated nets 120, 121 have been omitted for clarity. FIG. 9 is an enlarged sectional view through the region of mat 102 where the base portion 109 is continuous with the side portion 110, and associated parts. Individual second bungee cords 113 pass through a fabric loop 122 and are coupled to a clip 123 which hooks over second circumextending support 117. The fabric loop 122 is held in place beneath the jumping mat 102 between underside 124 of mat 102 and webbing 125. A second piece of webbing 126 is provided on top surface 127 to provide reinforcement and stitching is provided through the several layers of webbing 126, mat 102, fabric loop 122 and webbing 125. For ease of illustration, the thickness of these layers has been exaggerated in FIG. 9.

It should be understood that because the warp and weft of the woven elasticated material of the one-piece jumping mat is continuous through the assembly of FIG. 9, tension is transmitted through the assembly between base portion 109 and side portion 110 of the jumping mat 102 in a largely uninterrupted fashion. Again, because the mat 102 is in one piece rather than being formed of several pieces joined together, the side portion 110 of the mat, shown in section, will not form an exactly straight line, but will be very slightly curved, and there may also be a very slight curvature in the base portion. This effect has been exaggerated in FIG. 8 for the purpose of illustration. The terms "generally frustoconical", "generally flat" and "generally vertical" are intended to encompass this very slight departure from true frustoconical, true flatness and true verticality that will naturally occur due to one portion of the one-piece mat merging into another continuously.

Individual first bungee cords 112 pass through a fabric loop 128 and are coupled to a clip 129 which hooks over first circumextending support 116. The fabric loop 122 is held in place between underside 124 of the mat 102 and webbing 130.

As a further aid to avoid accidental injury to users of the trampoline or others in the vicinity, the portions of the circumextending supports 116, 117 between the positions of each clip 123, 129 are provided with a soft foam protection sleeve 131.

Figure 10:
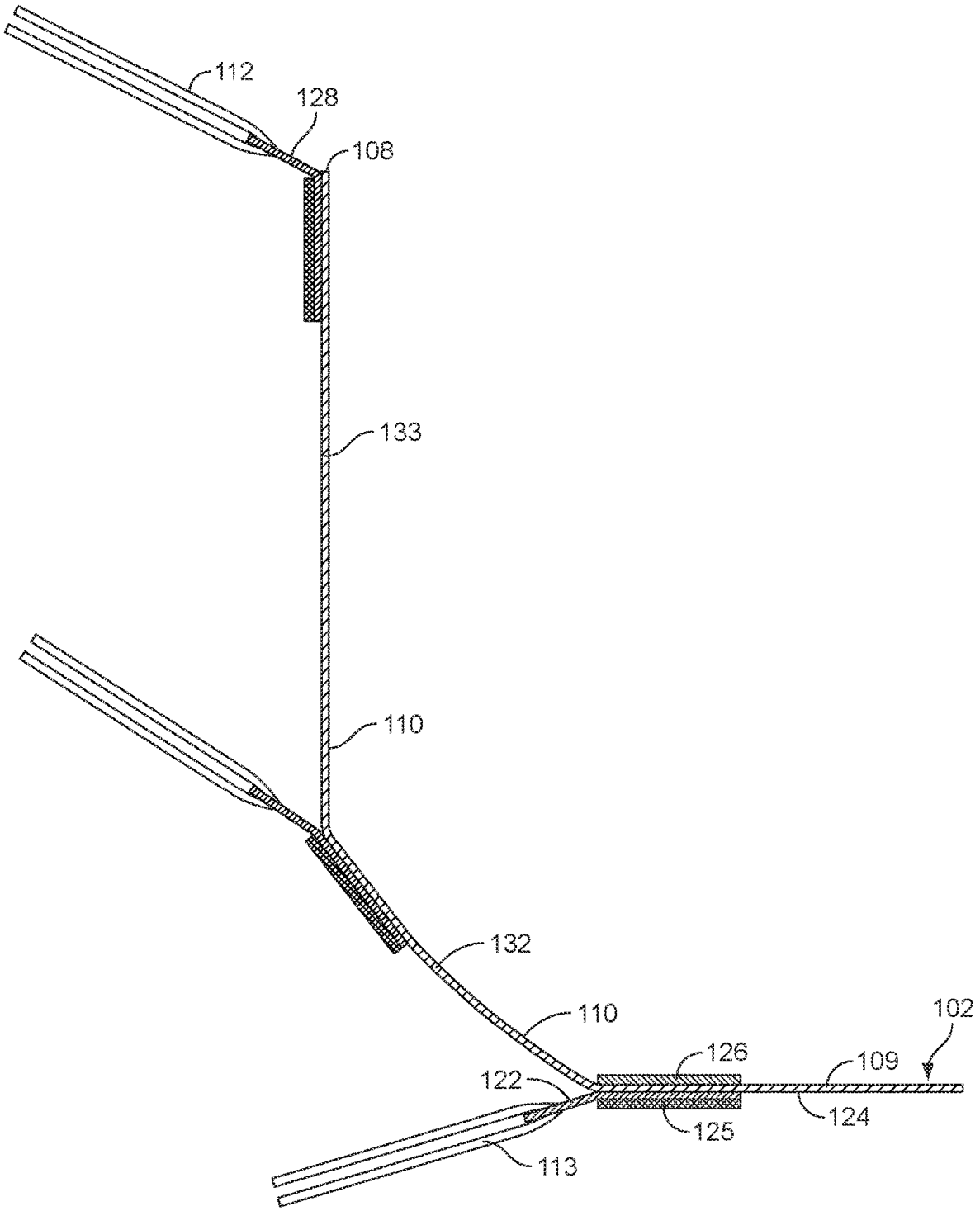
FIG. 10 is a sectional view similar to FIG. 9 for an alternative embodiment.

Referring to FIG. 10, which is a view similar to FIG. 9 through an alternative embodiment of trampoline, it will be seen that side portion 110 can itself be formed of a plurality of continuous sections between the region where it is continuous with base portion 109 and the peripheral edge 108 of the mat 102. Each portion further outward from lowermost portion 132 continuous with base portion 109 will have a smaller conic angle. In the illustrated arrangement, the outermost section 133 has a zero conic angle, extending vertically. In addition to the biasing connectors at the periphery 108 of the mat coupled to the first circumextending support, where each such section is continuous with another such section it will be provided with a set of biasing connectors (bungee cords in the illustrated arrangement) coupled to a respective circumextending support.

When a user jumps on the base portion 109 of the jumping mat, energy is stored in the whole of the mat, due to its unitary nature. It is the effective release of this stored energy that propels the user into a bounce. Applicant has found that the existence of seams between different components of a jumping mat formed from several pieces results in a degree of inertia and a slower response as compared with a one-piece jumping mat formed as a single elasticated woven fabric with warp and weft extending continuously through the material of the mat. The result with a one-piece mat is an enhanced, predictable and uniform bounce.

If the user should bounce on to the side portion 110, the energy of their jump is again distributed through the whole of the mat because of the continuous warp and weft of the material, and the user is propelled by the rebounding side portion back towards the centre of the base portion. The added height of the side portion in all cases of trampolines embodying the teachings of the present disclosure, but the more so in arrangements such as that of FIG. 10, makes it much less likely than in more conventional trampolines that a user will come into contact with the netting of a safety enclosure. The higher the side portion extends above the base portion of the trampoline mat, the less is there a need for netting and the shorter will be the height of netting with which a use may come in contact.

With no access to the springs or other biasing connectors for a user while jumping, with reduced chance for the user to fall off the trampoline while jumping, with what is effectively a soft landing on the side portion should the user fall, with a structure that returns a user making an errant bounce to the centre of the mat, and fewer collisions with the safety net, trampolines constructed in accordance with the teachings of the present disclosure are inherently very safe for users.

The invention claimed is:

1. A trampoline comprising: a frame and a jumping mat, the jumping mat being formed in a single piece from woven elasticated material, and comprising a generally flat base portion at a position lower than the periphery of the jumping mat, and an integral side portion continuous with the base portion around the entire periphery of the base portion and extending to the periphery of the jumping mat, the jumping mat being connected to the frame by at least two biasing connectors so that the jumping mat is supported under tension at a position above ground or flooring.

2. The trampoline according to claim 1, wherein the jumping mat has a generally dished configuration with the side portion adopting a generally frustoconical configuration.

3. The trampoline according to claim 2, wherein the at least two biasing connectors include:

a first biasing connector or a first set of biasing connectors connects the periphery of the jumping mat to the frame; and a second biasing connector or a second set of biasing connectors connects the frame to the jumping mat where an edge of the base portion is continuous with the side portion; and the second biasing connector or the second set of biasing connectors, together with the first biasing connector or the first set of biasing connectors, hold the jumping mat under uniform tension.

4. The trampoline according to claim 3, wherein at least one of the first and second biasing connectors comprises a continuous length of elastic webbing or bungee cord extending between the jumping mat and the frame.

5. The trampoline according to claim 2, wherein each of the at least two biasing connectors comprises a continuous length of elastic webbing or bungee cord extending between the jumping mat and the frame.

6. The trampoline according to claim 2, wherein the at least two biasing connectors are selected from a group of biasing connectors consisting of: helical springs, elastic webbing, individual elastic portions, individual elastic bungee cords, leaf springs, and flexible rods.

7. The trampoline according to claim 1, wherein the at least two biasing connectors include:

a first biasing connector or a first set of biasing connectors that connects the periphery of the jumping mat to the frame, and a second biasing connector or a second set of biasing connectors that connects the frame to the jumping mat where an edge of the base portion is continuous with the side portion;

the second biasing connector or the second set of biasing connectors, together with the first biasing connector or the first set of biasing connectors, hold the jumping mat under uniform tension.

8. The trampoline according to claim 7, wherein at least one of the first and second biasing connectors comprises a continuous length of elastic webbing, or bungee cord extending between the jumping mat and the frame.

9. The trampoline according to claim 7, wherein each of the first set and second set of biasing connectors are selected from a group of biasing connectors consisting of: helical springs, elastic webbing, individual elastic portions, individual elastic bungee cords, leaf springs, and flexible rods.

10. The trampoline according to claim 7, wherein the frame comprises:

a first circumextending support, to which the first biasing connector or the first set of biasing connectors is connected, and a second circumextending support, to which the second biasing connector or the second set of biasing connectors is connected, the second circumextending support being lower than the first circumextending support.

11. The trampoline according to claim 10, further comprising a net extending above the first circumextending support to reduce a risk of users falling from the trampoline.

12. The trampoline according to claim 10, further comprising a net extending below the first circumextending support or the second circumextending support to reduce access to the first biasing connector or the first set of biasing connectors, or the second biasing connector or the second set of biasing connectors.

13. The trampoline according to claim 10, further comprising a net extending below the second circumextending support down to a ground or floor level in order to prevent a person from accessing an area under the trampoline.

14. The trampoline according to claim 1, wherein the jumping mat is formed as a single flat disc of the woven elasticated material.

15. The trampoline according to claim 1, wherein the side portion of the jumping mat comprises two or more sections that integrally form the jumping mat together with the flat base portion, the two or more sections include:

a first side portion extending completely about and being continuous with the base portion, and a second side portion extending completely about and being continuous with the first side portion, the second side portion extending to the periphery of the jumping mat, and the at least two biasing connectors further include a third biasing connector or a third set of biasing connectors coupled between the frame and the jumping mat where the first and second side portions are continuous with each other.

16. The trampoline according to claim 15, wherein both of the first and second side portions have frustoconical configurations, with the second side portion making a smaller conical angle.

17. The trampoline according to claim 15, wherein the second side portion extends generally vertically.

* * * * *